United States Patent [19]

Bellini

[11] Patent Number: 4,826,329

[45] Date of Patent: May 2, 1989

[54] FLEXIBLE BAG, IN PARTICULAR FOR OFFICE MACHINES

[75] Inventor: Mario Bellini, Milan, Italy

[73] Assignee: Ing. C. Olivetti & C., S.p.A., Ivrea, Italy

[21] Appl. No.: 161,033

[22] Filed: Feb. 26, 1988

[30] Foreign Application Priority Data

Mar. 18, 1987 [IT] Italy ..... 53148/87[U]

[51] Int. Cl.[4] ..... B65D 30/00

[52] U.S. Cl. ..... 383/3; 383/98; 190/103

[58] Field of Search ..... 383/3, 98; 190/103, 190/124

[56] References Cited

U.S. PATENT DOCUMENTS

| | | | |
|---|---|---|---|
| 3,587,794 | 6/1971 | Mattel | 383/3 |
| 3,711,175 | 1/1973 | Sottsass, Jr. | 312/208 |
| 4,044,867 | 8/1977 | Fisher | 383/3 |
| 4,468,810 | 8/1984 | Longo | 383/3 |
| 4,503,558 | 3/1985 | Lief et al. | 383/3 |

FOREIGN PATENT DOCUMENTS

| | | | |
|---|---|---|---|
| 704493 | 2/1954 | United Kingdom | 383/3 |
| 2157552 | 10/1985 | United Kingdom | 383/3 |

*Primary Examiner*—Willis Little

*Attorney, Agent, or Firm*—Banner, Birch, McKie & Beckett

[57] ABSTRACT

The flexible bag comprises a container of flexible plastics material having an internal sheet and an external sheet which define a sealed chamber which can be filled with air at low pressure. The sealed chamber is composed of a series of tubes separated by welded seams but in communication with each other. The air causes the container to assume a substantially parallelepipedic external shape and produces an internal housing which is defined by the internal flexible sheet and which is capable of housing an office machine, for example a portable typewriter. The container comprises two handles projecting from the parallelepipedic shape, for facilitating transportation of the container itself, and a valve to permit the container to be inflated only when it is to be used for the protection or transportation of the machine. The container may be easily deflated and in that case can be re-folded on to itself in order substantially to reduce its bulk. In addition the container has an opening at a position corresponding to the two handles to permit the passage, therethrough of the machine, and two movable flap portions having closure means for closing the opening, which are disposed adjacent to the two handles.

6 Claims, 2 Drawing Sheets

FLEXIBLE BAG, IN PARTICULAR FOR OFFICE MACHINES

BACKGROUND OF THE INVENTION

The present invention relates to a flexible bag, in particular for office machines, provided with a container which is capable of housing the machine to protect it and make transportation thereof easier.

From the U.S. Pat. No. 3,711,175 a case is known, formed by a container of rigid plastics material for housing an office machine therein. While such case is functional, it does however suffer from the disadvantage of being rather bulky when the machine is removed from the case. In addition, the cost thereof is inherently fairly high due to the high cost of the moulds necessary for producing it.

A portable office machine could also be housed in a conventional flexible bag formed by sheets of flexible plastics material. Such bags are inexpensive but they suffer from the disadvantages that they do not provide adequate protection for the machine from shocks and impact during transportation thereof and they do not permit the machine to be easily introduced into the inside thereof, by virtue of the flexibility of the material used.

SUMMARY OF THE INVENTION

The object of the present invention is to provide a container for easily housing and transporting an office machine, which is inexpensive, of reduced bulk, reliable and which at the same time adequately protects the machine and is very easy to use.

To that end, the invention provides a flexible bag wherein the container is of flexible plastics material having an internal sheet and an external sheet which are welded together and which define a sealed chamber capable of being filled with air at low pressure and such as to cause the container to assume a substantially parallelepipedic external shape and to provide an internal cavity for housing the machine, and wherein the container comprises two projecting handles for facilitating transportation of the container.

BRIEF DESCRIPTION OF THE DRAWING

A preferred embodiement of this invention is set forth in the following description which is given by way of non-limiting example with reference to the accompanying drawing in which.

DESCRIPTION OF THE PREFERRED EMBODIEMENT

Figure 1:
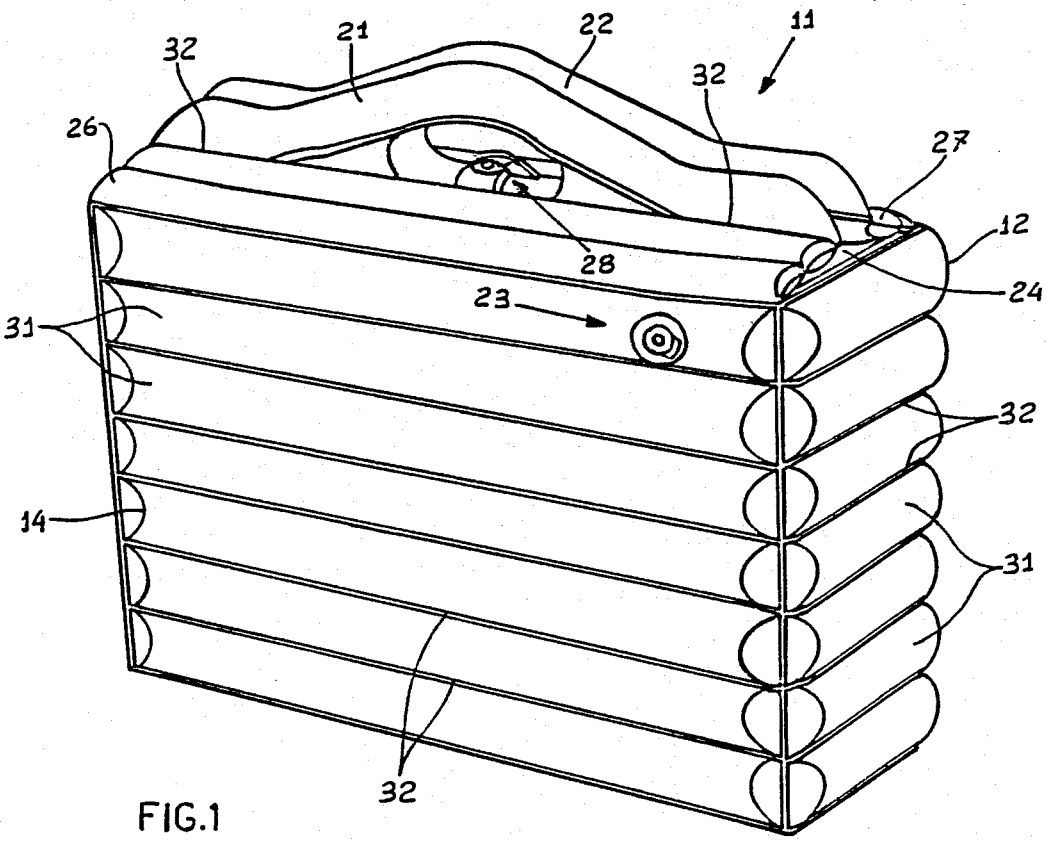
FIG. 1 is a perspective view of the flexible bag.
Figure 2:
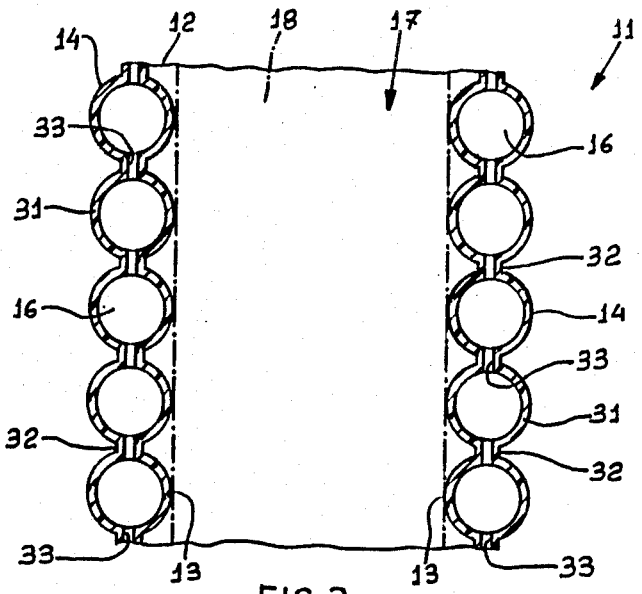
FIG. 2 is a view in section of part of the bag shown in FIG. 1 on a reduced scale.

Referring to FIGS. 1 and 2, the flexible bag 11 comprises a container 12 of flexible plastics material having an internal surface 13 and an external surface 14 which are formed by two sheets welded together in known manner per se, to define a sealed chamber 16 which can be filled with low-pressure inflating air. This causes the container 12 to assume a substantially parallelepipedic external shape such as to provide an internal cavity 17 for housing for example a portable electronic typewriter which is indicated generally by reference numeral 18 and which is partly shown in dash-dotted lines in FIG. 2. The container 12 comprises two handles 21 (see FIG. 1) and 22 which project from the parallelepipedic shape and which can be used for transporting the container itself and elements, which are generally indicated by reference numeral 23, to permit inflation of the bag when the container 12 is to be used and deflation thereof when the container 12 is not in use. In the latter case, the bag can be re-folded on to itself in such a way as substantially to reduce the bulk thereof in known manner per se.

The flexible bag 11 has an opening 24 at a position corresponding to the handles 21 and 22 to permit the machine 18 to pass therethrough. The container 12 further comprises two movable flaps 26 and 27, from the ends of which project the two handles 21 and 22. The movable flaps 26 and 27 are adjacent to the opening 24 and comprise closure means which are generally indicated at 28 and which co-operate with each other to open and close the opening 24 and which are disposed adjacent to the respective handles 21 and 22.

The container 12 is made in one piece comprising the internal surface 13 and the external surface 14, the handles 21 and 22, the inflating elements 23, the movable flaps 26 and 27 and the closure means 28. In particular the two sheets of the container 12 are welded in such a way as to form a series of tubes 31 of cylindrical section (see FIG. 2) which are connected together by means of flexible elastic seams 32 having a series of internal openings 33 for allowing the air to pass between each of the tubes 31 thereby to form the sealed chamber 16. Therefore the internal and external surfaces 13 and 14 are formed by the external parts of the tubes 31 and each surface is formed by a series of mutually adjacent semi-cylinders.

Similarly, the movable flaps 26 and 27 are each formed by two tubes of cylindrical section which are connected, by means of the junctions 32 and the openings 33, to the body of the container 12 and to the respective handles 21 and 22. Each handle 21 and 22 is also formed by a handle member-shaped tube having the lower ends connected to the respective tube of the movable flaps 26 and 27.

Figure 3:
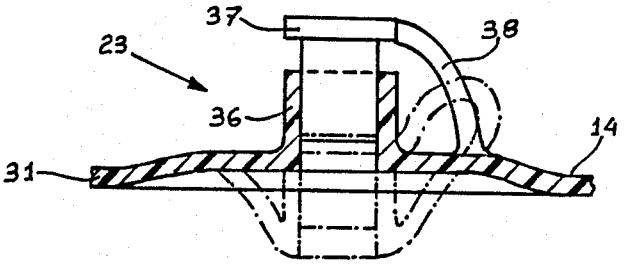
FIG. 3 is a partial section of some details from FIG. 1 on an enlarged scale.

The elements 23 for inflating and deflating the bag 11 comprise a tube portion 36 (see FIG. 3) of flexible plastics material which is welded to the external sheet forming the cylindrical tube 31, and a cylindrical plug 37 connected by a strip as at 38, fixed with respect to and in one piece with the cylindrical tube 31. The tube portion 36 and the plug 37 can be pulled out from the external surface 14 of the tube 31 to permit inflation of the container 12 as shown in solid lines in FIG. 3 and thus also for deflation thereof and they can be subsequently returned within the surface 14 as shown in dash-dotted lines in FIG. 3, in known manner per se.

Figure 4:
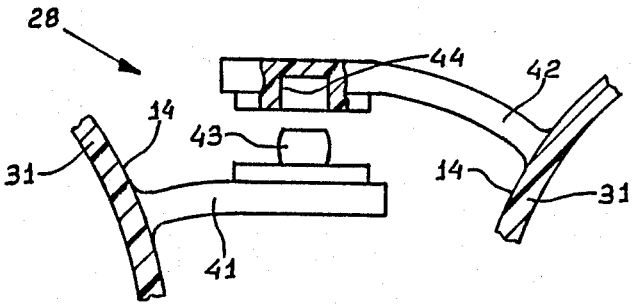
FIG. 4 shows a partial section of other details from FIG. 1 on an enlarged scale.

The closure means 28 of the bag comprise two elastic strips 41 (see FIG. 4) and 42 which are each fixed with respect to and in one piece with the external surface of the tube 31 of the respective movable flaps 26 and 27. Fixedly secured to the strip 41 is a stud 43 while disposed on the strip 42 is a seat 44 capable of engaging with the stud 43 to hold the two movable flaps 26 and 27 in joined relationship, thereby to close the opening 24 of the bag. As will be clearly seen from FIG. 1, the closure means 28 are fixed in the intermediate portion of the movable flaps 26 and 27 and are adjacent to the respective handles 21 and 22.

The operations involved in inflating or deflating the flexible bag 11 are very simple. Firstly, the tube portion 36 is pulled out from within the external surface 14, the plug 37 is removed and air is blown through the tube portion 36 into the sealed chamber 16. The air passes through the openings 33 and causes inflation of all the tubes 31, the movable flaps 26 and 27 and the handles 21 and 22. As soon as the bag 11 has assumed the shape shown in FIG. 1, that is to say the sealed chamber is nicely taut, the plug 37 is put in and the tube portion 36 which is closed by the plug 37 is pushed into a position within the external surface 14, as shown in dash-dotted lines in FIG. 3. The bag 11 now has the cavity thereof ready to house the machine 18. When the machine 18 is introduced into the opening 24, the opening is closed by means of the two movable flaps 26 and 27 and the bag is closed, engaging the seat 44 with the stud 43. The user holds the handles 21 and 22 to transport the flexible bag 11. The machine 18 is protected from shock and impact by virtue of the damping effect of the tubes 31.

When the user is to use the machine 18, he disengages the seat 44 from the stud 43 and opens the opening 24, positioning the movable flaps 26 and 27 with the handles 21 and 22 laterally. He then removes the machine 18. Subsequently, if the bag is to be put away again, the tube portion 36 is pulled to the outside of the external surface 14 and the plug 37 is removed. The air flows out through the tube portion 36 and therefore the bag 11 deflates and becomes flabby, greatly reducing the bulk thereof. As soon as the air has escaped from the sealed chamber 16, the plug 37 is put back in in order to prevent any dirt from getting in, and thus the bag 11 when completely deflated can be put back into any drawer, of minimum size.

It will be apparent therefore that the internal sheet 13 and the external sheet 14 which are closed to each other define a sealed chamber 16 which can be filled with low-pressure air, causing the container 12 to assume a substantially parallelepipedic external shape and being such as to provide a housing 17 for an office machine 18. In addition the specific design configuration provides for the use of tubes 31 of cylindrical section, which are produced by welding from the two sheets and which are connected together by means of seams 32 having internal openings 33 for the air to pass therethrough. That structure makes it possible to produce a simple container 12 which is of reduced size. In addition, when the chamber 16 is inflated, it permits the flexible bag 11 to absorb and damp any impact or shocks during transportation without the machine 18 suffering harm and being damaged.

What I claim is:

1. A flexible bag in particular for office machines, comprising a container for housing an office machine for protecting the machine and making transportation thereof easier, wherein the container is of flexible plastic material having an internal sheet and an external sheet which are welded together for defining a sealed chamber capable of being filled with air at low pressure and such as to cause the container to assume a substantially parallelepipedic external shape having an opening for allowing the machine to pass therethrough and an internal cavity for housing the machine, wherein the internal sheet and the external sheet are welded in such a way as to form a series of tubes of cylindrical section and a series of flexible elastic seams for connecting the series of tubes, wherein the internal sheet and the external sheet are formed by external parts of said tubes of said series of each sheet is formed by a series of mutually adjacent semicylinders which define internal walls and external walls of the container, two movable flaps positioned adjacent to the opening and having closure means for opening and for closing the opening, two handles which project from the parallelepipedic shape for facilitating transportation of said container, and elements for permitting the container to be inflated when it is to be used and to be deflated when it is not in use and to reduce the bulk thereof, wherein said elements are positioned in one tube of said series, wherein the plurality of flexible elastic seams comprises a series of internal openings for allowing the air to pass between each of series of tubes thereby to form said sealed chamber, wherein the movable flaps are each formed by two tubes of said series connected by the flexible elastic seams, and wherein each handle is formed by a handle member-shaped tube having the lower ends connected by the flexible elastic seams to the respective tube of the movable flaps.

2. A flexible bag according to claim 1, wherein the closure means cooperate with each other to open and close the opening, are disposed in the intermediate portion of the movable flaps, are adjacent to the respective handles, and comprise two elastic strips which are each fixed with respect to and in one piece with the external part of the one tube of the respective movable flaps, wherein the first strip has a stud integral with the first strip and the second strip has a seat capable of engaging with the stud for holding the two movable flaps in joined relationship thereby to close the opening.

3. A flexible bag according to claim 1, wherein the elements for permitting inflation and deflation of the container comprise a tube portion and a plug which is capable of engaging with the tube portion to prevent the air from escaping, wherein the tube portion is integral with the external part of the one tube, and wherein the plug has a strip integral with the external part of the one tube.

4. A flexible bag according to claim 3, wherein the tube portion and the plug can be extracted from the external part of the one tube to permit the container to be inflated and are subsequently foldable into and set back in said external part.

5. A flexible bag according to claim 1, wherein the container is formed in one piece comprising the internal and external sheets, the two movable flaps, the closure means, the handles, the tube portion and the plug.

6. A flexible bag according to claim 1, wherein when the container houses the machine and when the sealed chamber is inflated, the container is capable of absorbing and damping shocks during transportation without the machine suffering harm and therefore being damaged

* * * * *